US005101470A

United States Patent [19]

Reynolds

[11] Patent Number: 5,101,470

[45] Date of Patent: Mar. 31, 1992

[54] FIBER OPTIC LIGHT SENSOR FOR SAFING AND ARMING A FUZE

[75] Inventor: John E. Reynolds, Plymouth, Minn.

[73] Assignee: Alliant Techsystems Inc., Edina, Minn.

[21] Appl. No.: 683,006

[22] Filed: Apr. 10, 1991

[51] Int. Cl.[5] ..... G02B 6/00; F42C 15/00; F42B 13/50

[52] U.S. Cl. ..... 385/147; 102/254; 102/256

[58] Field of Search ..... 102/209, 215, 254, 256; 350/96.10, 96.20–96.22

[56] References Cited

U.S. PATENT DOCUMENTS

| | | | |
|---|---|---|---|
| 3,901,597 | 8/1975 | White | 356/4 |
| 3,935,818 | 2/1976 | Johnson et al. | 102/70.2 P |
| 3,937,575 | 2/1976 | Bateman | 356/5 |
| 4,029,016 | 6/1977 | Cole | 102/254 X |
| 4,072,108 | 2/1978 | Lewis et al. | 102/70.2 R |
| 4,309,946 | 1/1982 | Block | 102/213 |
| 4,377,113 | 3/1983 | Florence | 102/209 |
| 4,505,582 | 3/1985 | Zuleeg et al. | 356/5 |
| 4,576,346 | 3/1986 | Gauggel et al. | 244/3.16 |
| 4,611,912 | 9/1986 | Falk et al. | 356/5 |
| 4,683,823 | 8/1987 | Dinger et al. | 102/256 X |
| 4,733,609 | 3/1988 | Goodwin et al. | 102/213 |
| 4,776,274 | 10/1988 | Kriz et al. | 102/213 |
| 4,824,251 | 4/1989 | Slotwinski et al. | 356/349 |
| 4,831,934 | 5/1989 | Golay et al. | 102/209 |
| 4,854,239 | 8/1989 | Van Sloun | 102/254 X |
| 4,859,054 | 8/1989 | Harrison | 356/5 |

*Primary Examiner*—Akm Ullah
*Attorney, Agent, or Firm*—Jane H. Arrett

[57] ABSTRACT

An arrangement used in safing and arming a munition fuze includes a light sensor, a magnet, and a circuit composed of an inductor coil, a storage capacitor, and a photosensitive device. The light sensor is a fiber optic cable which responds to a flash of light generated by burning propellant of the munition by receiving and guiding the light energy to the photosensitive device. The magnet responds to setback of a projectile of the munition to move relative to the coil and generate an electrical voltage. The photosensitive device connected to the inductor coil responds to the voltage generated and to receipt of light energy from the light sensor by conducting electrical energy. An electro-explosive actuator connected to the photosensitive device is operable in response to conducting of electrical energy to actuate a rotor of the munition fuze from an unarmed condition to an armed condition. The electro-explosive actuator is thus incapable of actuating the fuze rotor from the unarmed condition to armed condition without both the setback force and burning of the propellant occurring first.

18 Claims, 3 Drawing Sheets

FIBER OPTIC LIGHT SENSOR FOR SAFING AND ARMING A FUZE

BACKGROUND OF THE INVENTION

1. Field of the Invention

The present invention generally relates to munitions employing materials which need to be ignited or detonated to attain proper function and, more particularly, is concerned with a fiber optic light sensor for safing and arming a fuze used to ignite or detonate the munition.

2. Description of the Prior Art

Munitions which contain materials that need to be ignited or detonated to attain proper function typically have a safing and arming arrangement operable to ensure that arming of the munition fuze does not occur inadvertently, but rather only at a desired moment. A fuze is considered "armed" generally when an explosive train is "in line", that is, when the detonator is in position to initiate the booster charge or main charge of the munition. Examples of these types of munitions may include high explosive, shaped charge, illumination, and smoke projectiles.

Preferably, the intent of using a safing and arming arrangement is to provide a munition which only functions under a narrowly defined set of conditions, for example, the conditions which exist when the munition is propelled from its launcher. These environmental conditions can be used to arm the fuze.

A conventional type of a launcher is a projectile-firing device, composed essentially of a projectile-guide tube incorporating a reaction chamber in which chemical energy of a propellant is rapidly converted into heat. The hot gases produced expand to expel the projectile at a high velocity. The reaction of the propellant produces the conditions which can be used to arm the fuze. The environmental conditions which the projectile is subjected to include setback (the high acceleration of launch), pressure, heat, noise, light and spin (if the launcher is rifled).

A need still remains for a way to utilize the light produced by the igniting and burning propellant as a primary or secondary safing environment for a fuze.

SUMMARY OF THE INVENTION

The present invention provides a fiber optic light sensor arrangement designed to satisfy the aforementioned needs. The arrangement of the present invention senses a brilliant flash of light produced by burning propellant in a cartridge case of the munition. The light is detected by a photo diode via a fiber optic cable which acts as a light guide for the propellant flash. The photo diode is powered by voltage produced by a magnet which moves past a coil at projectile setback. The combination of setback and the flash of light causes the photo diode to become electrically conductive which provides a signal used to arm the fuze.

Accordingly, the present invention is directed to an arrangement for use in safing and arming a fuze in a munition. The arrangement comprises: (a) first means responsive to the occurrence of a first environmental condition of the munition for introducing light energy; (b) second means responsive to the occurrence of a second environmental condition of the munition for generating an electrical voltage, the second environmental condition being different from the first environmental condition; (c) third means responsive to generation of the voltage and introduction of the light energy for conducting electrical energy; and (d) fourth means responsive to conducting of the electrical energy for actuating the munition fuze from an unarmed condition to an armed condition.

More particularly, the first means of the arrangement being responsive to the first environmental condition is a light guide responsive to light generated by the burning of a propellant of the munition. The second means of the arrangement being responsive to the second environmental condition includes a magnet and an electrical induction coil responsive to a setback, or initial acceleration, of the projectile of the munition, such as caused by ignition of the propellant or by an inadvertent non-ignition related impact force against the munition, to generate the electrical voltage. The third means being responsive to generation of the voltage and introduction of light energy is a photosensitive device, such as a photo diode detector, connected to the coil. The third means is switched "on" to a conducting mode when receiving light energy. In the absence of light energy, the third means is switched "off" to a non-conducting mode. The fourth means of the arrangement being responsive to conducting of the electrical energy is an actuator, such as an electro-explosive actuator. When the electro-explosive actuator receives electrical energy it produces an electro-explosive force of a magnitude sufficient to actuate a rotor of the munition fuze from an unarmed condition to an armed condition.

The light guide of the first means is responsive to the flash of light produced by the burning of the propellant for transmitting sufficient light energy from the chamber of the munition which contains the burning propellant to the photosensitive device of the third means to cause the device to turn "on" and to conduct electrical energy to the fourth means. On the other hand, the absence of light transmitted by the light guide prevents the photosensitive device from turning "on". The device thus remains turned "off" and unable to conduct electrical energy to the fourth means. Thus, the fourth means is incapable of actuating the fuze rotor from the unarmed condition to armed condition without both the first and second environmental conditions of the munition occurring first, namely setback of the munition projectile and ignition of the propellant of the munition.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

In General

Figure 1:
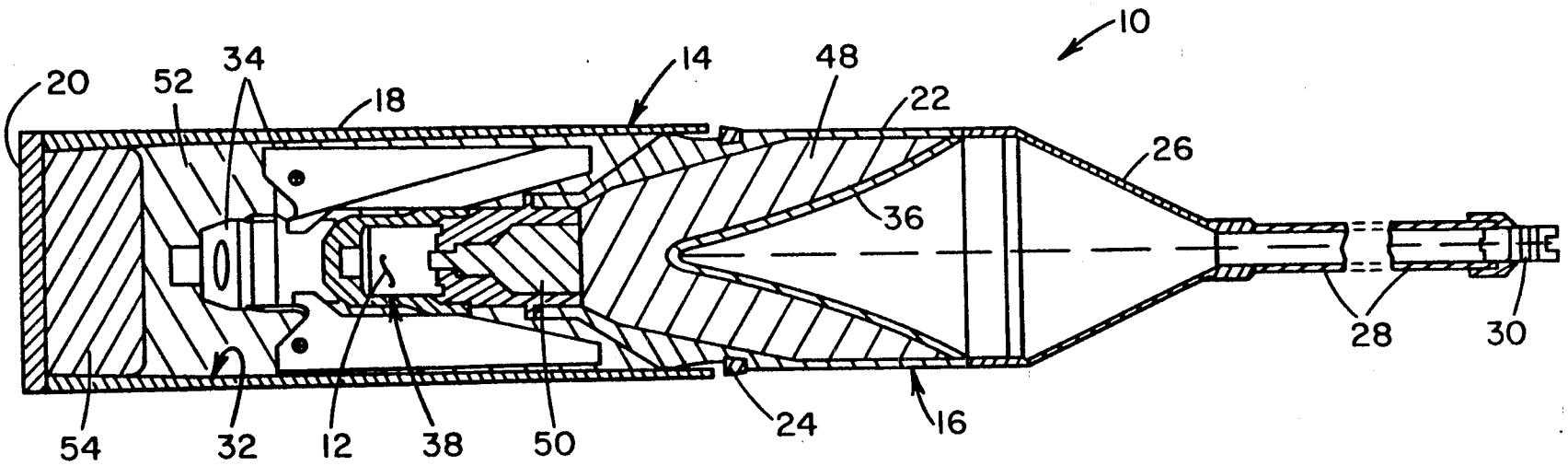
FIG. 1 is a longitudinal axial sectional view of a munition employing a fiber optic light sensor arrangement of the present invention.

Referring to the drawings, and particularly to FIG. 1, there is shown an example of a munition, generally designated 10, in which is employed a fiber optic light sensor arrangement 12 in accordance with the present invention. The munition 10 shown in FIG. 1 is but one example of a munition in which the fiber optic light sensor arrangement 12 of the present invention can be employed. The munition 10 illustrated in FIG. 1 forms no part of the present invention, and so will be described hereinafter only in the detail needed for one of ordinary skill in the art to understand the present invention.

The munition 10 is composed of a cartridge case 14 and a projectile 16. The cartridge case 14 is composed of a cylindrical sidewall 18 and aft base plate 20. The base plate 20 is attached, such as by crimping, to the aft end of the cylindrical sidewall 18 to close the rear end of the sidewall 18. The projectile 16 is mounted within and extends forwardly from a forward open end of the case sidewall 18.

The projectile 16 includes an elongated body 22 which is attached, such as by crimping, to the forward open end of the cartridge case sidewall 18 approximately midway along the length of the body 22 at a location immediately aft of an annular sealing ring 24 which is seated about the projectile body 22. A windscreen 26 is threaded to the forward end of the projectile body 22 and a standoff probe 28, having an impact sensor 30 on its leading end, is threaded to and extends forwardly from the windscreen 26.

The projectile body 22 extends rearwardly within a chamber 32 defined by the cartridge case 14 and has a fin holder 34 mounted about the exterior of the rear end of the body 22, a shaped charge liner 36 disposed within the forward portion of the body 22, and a fuze 38 disposed within a rearward portion of the body 22.

Figure 2:
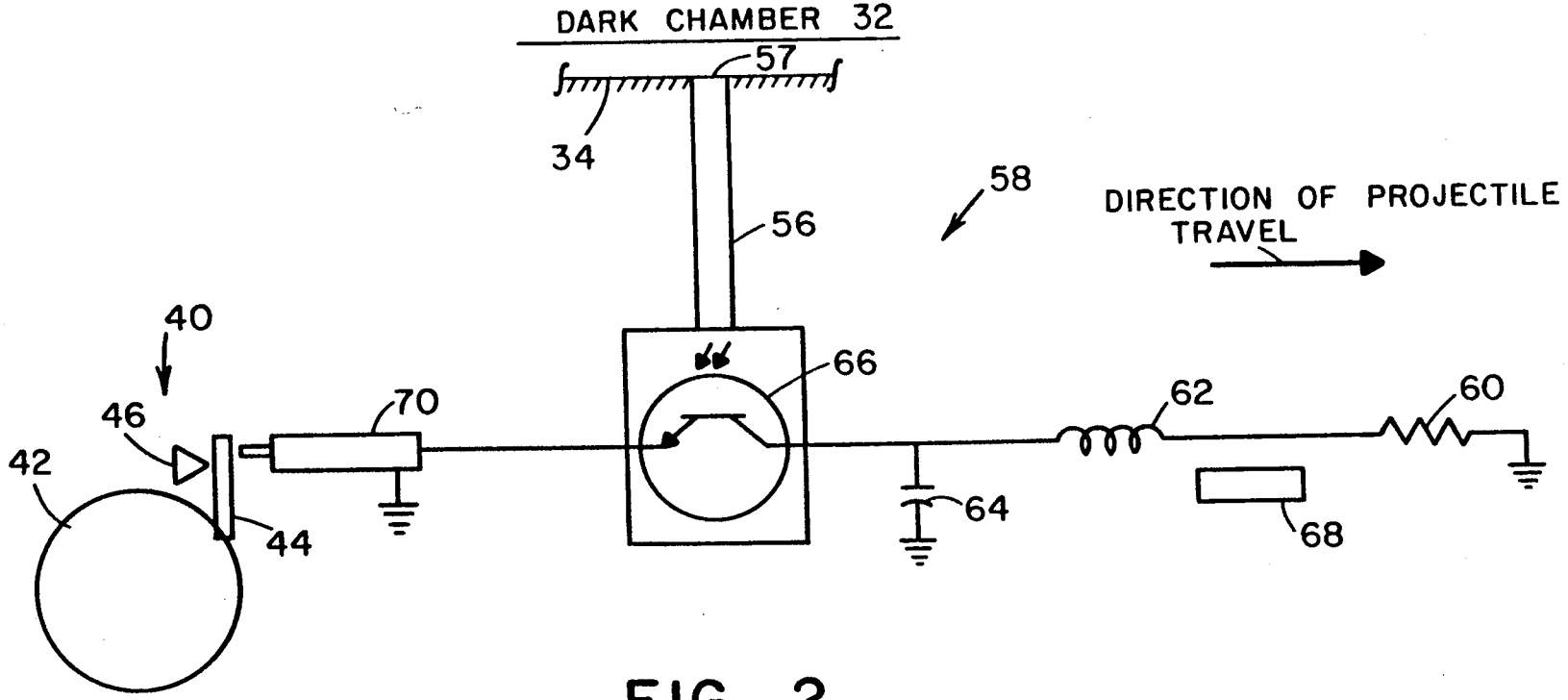
FIG. 2 is a schematic view of the fiber optic light sensor arrangement of the present invention illustrating conditions that exist prior to munition firing.
Figure 3:
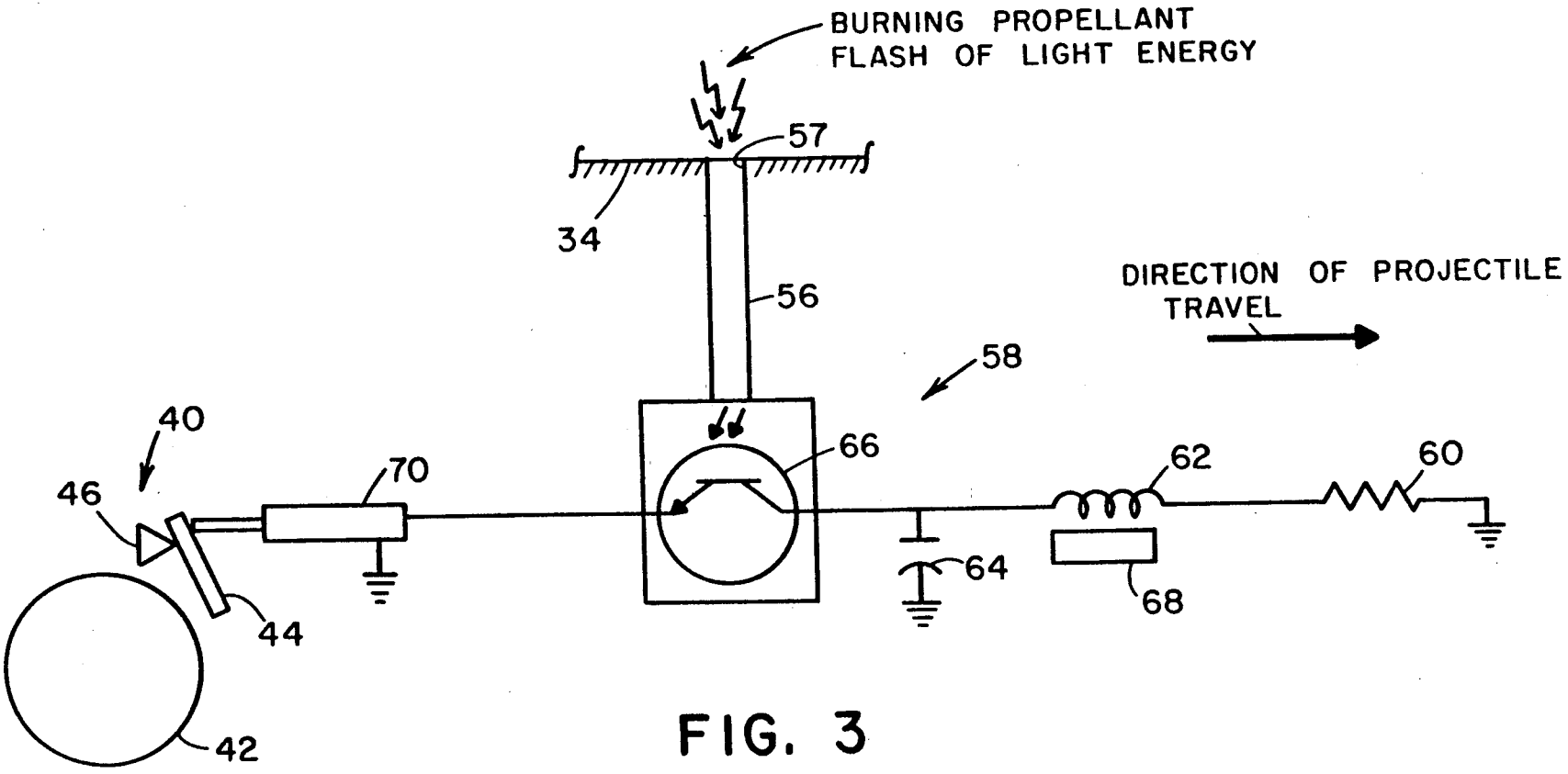
FIG. 3 is a schematic view of the fiber optic light sensor arrangement illustrating conditions that exist at the time of munition firing.

FIGS. 2 and 3 schematically illustrate a safing and arming device 40 in the fuze 38. The safing and arming device 40 includes a fuze rotor 42 and a lever 44. The lever 44 holds the rotor 42 which contains a detonator (not shown) in an unarmed or safe condition. Pivoting of the lever 44 about a fulcrum 46 away from the rotor 42 permits the rotor 42 to turn to an armed condition for detonating the fuze 38.

Also, a main explosive charge 48 is housed within the projectile body 22 about the exterior of and extending rearwardly of the shaped charge liner 36. A booster charge 50 is disposed within the projectile body 22 between the main explosive charge 48 and the fuze 38.

A propellant 52 is positioned in the chamber 32 of the cartridge case 14 rearwardly of and surrounding the fin holder 34 and the rear portion of the projectile 16. A primer cap assembly 54 is located in the chamber 32 on the interior side of the base plate 20 of the case 14. The primer cap assembly 54 is operable, when actuated in a conventional known manner, to ignite the propellant 52. The ignition and burning of the propellant 52 produces gases at high pressure within the chamber 32 which is sufficient to launch the projectile 16 from the case 14.

Fiber Optic Light Sensor of the Invention

Referring to FIGS. 2 and 3, there is schematically illustrated the fiber optic light sensor arrangement 12 in accordance with the present invention which is used in conjunction with the safing and arming device 40 in the munition fuze 38. In its basic components, the fiber optic light sensor arrangement 12 includes a light sensor 56, a circuit 58 composed of a resistor 60, an electrically conductive inductor coil 62, a storage capacitor 64, and a photosensitive device 66. The arrangement 12 also includes a permanent magnet 68 reciprocally movable adjacent and parallel to the coil 62.

The light sensor 56 of the arrangement 12 responds to the occurrence of a first environmental condition of the munition 10, such being a flash of light generated by igniting and burning of the propellant 52 of the munition 10 employed in launching the projectile 16, by guiding a sufficient amount of the light energy so generated to the photosensitive device 68 to activate the device 68. FIG. 2 depicts a dark chamber 32 adjacent the light sensor 56, whereas FIG. 3 depicts the flash of light generated by the burning propellant. Preferably, the light sensor 56 is a fiber optic cable 56, as shown schematically in FIGS. 2 and 3, which communicates with the chamber 32 of the case 14 through an opening 57 in the fin holder 34.

The permanent magnet 68 associated with the inductor coil 62 of the circuit 58 responds to the occurrence of a second environmental condition of the munition 10, the setback or reaction force produced by launching of the projectile 16, by moving relative to the inductor coil 62. The direction of movement of the projectile 16 is indicated by the arrow in FIGS. 2 and 3. By such movement, the magnetic field of the magnet 68 interacts with the coil 62 to generate an electrical voltage for powering the photosensitive device 66. The second environmental condition, which is the setback of the projectile 16, is thus different from the first environmental condition, the burning of the propellant 52. Parenthetically, it should be noted that the setback force can also be produced by a non-launch event, such as an inadvertent dropping of the munition 10 on its base plate 20. However, since the first environmental condition, the ignition of the propellant and generation of the flash of light, would not occur as a result of an inadvertent dropping of the munition 10, then there would be no light energy introduced to the photosensitive device 66 solely on the occurrence of the non-launch setback force.

The electrical voltage produced by the movement of the magnet 68 relative to the coil 62 provides the power necessary to operate the photosensitive device 66. The storage capacitor 64 stores electrical charge for the duration of the event until the photosensitive device 66 becomes conductive. The resistor 60 prevents the charge from bleeding rapidly to ground potential.

The photosensitive device 66, which can be a photo diode or transistor, is electrically connected to the coil 62. The photosensitive device 66 when powered by the voltage generated by the interaction of the magnet 68 and coil 62 is switched "on" to a conducting mode when receiving light energy. In the absence of light energy, the device 66 is switched "off" to a non-conducting mode. Thus, in response to introduction of light energy by the light sensor 56 and to generation of the electrical voltage by the magnet 68 and coil 62, the photosensitive device 66 will conduct electrical energy.

The fiber optic light sensor arrangement 12 also includes an electro-explosive actuator 70, such as an explosively-activated piston actuator, electrically connected to the photosensitive device 66. The electro-explosive actuator 70 is operable in response to conducting of the electrical energy or current by the photosensitive device 66 to produce a mechanical force of a magnitude sufficient to actuate or push the lever 44 to release the fuze rotor 42 and permit it to move the unarmed to armed condition.

Thus, it can be understood that the actuator 70 is incapable of actuating the fuze rotor 42 from the unarmed condition to armed condition without both the first and second environmental conditions of the munition 10 occurring first, namely setback of the munition projectile 16 and ignition of the propellant 52 of the munition 10. The fuze 38 of the munition 10 will arm only when both setback and the pressure from burning propellant 52 are present. If a condition were to occur where there was setback but no flash of light (such as when the munition was dropped from a great height and landed on the base plate 20), then the fuze 38 would not arm because the photosensitive device 66 would not be activated to conduct electrical energy. Conversely, if a condition were to occur where there was a flash of light but no setback (such as in the case of a fire), then the fuze 38 would not arm because the magnet 68 would not move and its field not interact with the coil and consequently no voltage would exist to power the photosensitive device 64.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

Having thus described the invention, what is claimed is:

1. An arrangement for use in safing and arming a fuze in a munition, said arrangement comprising:

(a) first means responsive to the occurrence of a first environmental condition of the munition for . introducing light energy;

(b) second means responsive to the occurrence of a second environmental condition of the munition for generating an electrical voltage, the second environmental condition being different from the first environmental condition;

(c) third means responsive to the generation of the voltage and the introduction of the light energy for conducting electrical energy; and (d) fourth means responsive to the conducting of the electrical energy for actuating a rotor of the munition fuze from an unarmed condition to an armed condition, said first means being operable to transmit sufficient light energy to said third means to cause said third means to conduct electrical energy to said fourth means, whereas, in the absence of light transmitted by said first means, said third means is unable to conduct electrical energy to said fourth means, said fourth means thereby being incapable of actuating the fuze rotor from the unarmed condition to armed condition without both the first and second environmental conditions of the munition occurring first.

2. The arrangement of claim 1 wherein said first means responsive to the first environmental condition is a light guide responsive to light produced by the igniting of a propellant of the munition.

3. The arrangement of claim 2 wherein said light guide is a fiber optic cable.

4. The arrangement of claim 1 wherein said second means responsive to the second environmental condition includes:

an electrical coil; and a magnet movably mounted adjacent to said coil and responsive to a force of a predetermined magnitude imposed by a setback of a projectile of the munition to move relative to said coil such that a magnetic field of said magnet interacts with said coil to generate an electrical voltage in said coil.

5. The arrangement of claim 4 wherein said third means responsive to the generation of the voltage and the introduction of light energy is a photosensitive device connected to said coil, said photosensitive device being operable to switch "on" to a conducting mode when receiving light energy, said photosensitive device being operable to switch "off" to a non-conducting mode in the absence of light energy.

6. The arrangement of claim 4 wherein said second means also includes a storage capacitor connected to said coil.

7. The arrangement of claim 4 wherein said second means also includes a resistor connected between said coil and ground potential.

8. The arrangement of claim 1 wherein said third means responsive to the generation of the voltage and the introduction of light energy is a photosensitive device connected to said second means, said photosensitive device being operable to switch "on" to a conducting mode when receiving light energy, said photosensitive device being operable to switch "off" to a non-conducting mode in the absence of light energy.

9. The arrangement of claim 8 wherein said fourth means responsive to the conducting of the electrical energy is an electro-explosive actuator connected to said photosensitive device, said electro-explosive actuator in response to said electrical energy being operable to produce a mechanical force of a magnitude sufficient to actuate the fuze rotor from the unarmed condition to the armed condition.

10. The arrangement of claim 8 wherein said first means responsive to the first environmental condition is a light guide responsive to light produced by the igniting of a propellant of the munition and operable to transmit light energy to said photosensitive device.

11. The arrangement of claim 10 wherein said light guide is a fiber optic cable.

12. The arrangement of claim 10 wherein said light guide is operable to transmit sufficient light energy to said photosensitive device to cause said device to turn "on" and to conduct electrical energy to said fourth means, whereas, in the absence of light transmitted by said light guide, said photosensitive device is prevented from turning "on" and thus remains turned "off" and unable to conduct electrical energy to said fourth means, said fourth means thereby being incapable of actuating the fuze rotor from the unarmed condition to armed condition without both the first and second environmental conditions of the munition occurring first.

13. The arrangement of claim 4 wherein said fourth means responsive to the conducting of the electrical energy is an electro-explosive actuator connected to said third means, said electro-explosive actuator in response to the conducting of said electrical energy being operable to produce a mechanical force of a magnitude sufficient to actuate the fuze rotor from the unarmed condition to the armed condition.

14. An arrangement for use in safing and arming a fuze in a munition, said arrangement comprising:

(a) a fiber optic light guide responsive to the occurrence of a first environmental condition being the igniting of a propellant of the munition to receive and transmit light energy produced by the igniting of the propellant for introducing light energy;

(b) an electrical coil;

(c) a magnet movably mounted adjacent to said coil and responsive to the occurrence of a second environmental condition being a force of a predetermined magnitude imposed by a setback of a projectile of the munition to move relative to said coil such that a magnetic field of said magnet interacts with said coil to generate an electrical voltage in said coil;

(d) third means connected to the coil and aligned with said fiber optic light guide, said third means being responsive to the generation of the voltage and the introduction of the light energy for conducting electrical energy; and (e) fourth means connected to the third means and responsive to the conducting of the electrical energy for actuating a rotor of the munition fuze from an unarmed condition to an armed condition, said fiber optic light guide being operable to transmit sufficient light energy to said third means to cause said third means to conduct electrical energy to said fourth means, whereas, in the absence of light transmitted by said fiber optic light guide, said third means is unable to conduct electrical energy to said fourth means, said fourth means thereby being incapable of actuating the fuze rotor from the unarmed condition to armed condition without both the first and second environmental conditions of the munition occurring first.

15. The arrangement of claim 14 wherein said third means responsive to the generation of the voltage and the introduction of light energy is a photosensitive device connected to said coil, said photosensitive device being operable to switch "on" to a conducting mode when receiving light energy, said photosensitive device being operable to switch "off" to a non-conducting mode in the absence of light energy.

16. The arrangement of claim 14 further comprising: a storage capacitor connected to said coil.

17. The arrangement o f claim 14 further comprising: a resistor connected between said coil and ground potential.

18. The arrangement of claim 15 wherein said fourth means responsive to the conducting of the electrical energy is an electro-explosive actuator connected to said photosensitive device, said electro-explosive actuator in response to said electrical energy being operable to produce a mechanical force of a magnitude sufficient to actuate the fuze rotor from the unarmed condition to the armed condition.

* * * * *